United States Patent [19]

Suarez et al.

[11] Patent Number: 4,815,731

[45] Date of Patent: Mar. 28, 1989

[54] EXERCISE DEVICE

[75] Inventors: Richard A. Suarez, Canton; Adolf H. Friedebach, Cleveland, both of Ohio

[73] Assignee: Fitness Quest, Inc., Canton, Ohio

[21] Appl. No.: 111,803

[22] Filed: Oct. 23, 1987

[51] Int. Cl.[4] ..... A63B 21/02

[52] U.S. Cl. ..... 272/139; 272/137; 272/143

[58] Field of Search ..... 272/143, 142, 139, 138, 272/137, 136, 135, 125; 128/133, 134

[56] References Cited

U.S. PATENT DOCUMENTS

| | | | |
|---|---|---|---|
| D. 203,836 | 2/1966 | Hass | D34/5 |
| 1,538,845 | 5/1925 | Titus | 272/142 |
| 2,760,774 | 8/1956 | Perez | 272/57 |
| 2,937,023 | 5/1960 | Seymour et al. | 272/80 |
| 2,998,008 | 8/1961 | Klesa | 128/133 |
| 3,529,820 | 1/1969 | Templeton | 272/82 |
| 3,807,730 | 4/1974 | Dalton | 272/82 |
| 3,819,177 | 6/1974 | Spiro | 272/82 |
| 3,838,852 | 10/1974 | Gury | 272/82 |
| 4,200,281 | 4/1980 | Wang | 272/138 |
| 4,251,071 | 1/1981 | Norton | 272/137 |
| 4,273,328 | 6/1981 | Ozbey et al. | 272/137 |
| 4,340,218 | 7/1982 | Wilkinson | 272/136 |
| 4,411,426 | 10/1983 | McCoy | 272/126 |
| 4,423,866 | 1/1984 | Stolba | 272/125 |
| 4,489,937 | 12/1984 | Kong | 272/137 |
| 4,570,929 | 2/1986 | Shoemaker | 272/137 |

OTHER PUBLICATIONS

Black Master, Black Belt Mag., May 1980, p. 47.
Iso-Kick, Black Belt Mag., Nov. 1986, p. 113.

*Primary Examiner*—Richard J. Apley
*Assistant Examiner*—J. Welsh
*Attorney, Agent, or Firm*—Michael Sand Co.

[57] ABSTRACT

An exercise device for developing various parts of a user's body. A coil tension spring is attached and extends between a pair of cuff strips. The cuff strips are secured into loops by Velcro fastening strips for receiving the wrists and ankles of the user. An elastic cord is attached to metal rings and extends within the coil spring for limiting the separation distance of the cuff strips and to provide increased resistance as the spring is stretched. The spring and cord are secured on the cuff strips with metal rings which extend through loops formed on each of the cuff strips by a reinforcing strip of material sewed on the cuff.

5 Claims, 2 Drawing Sheets

EXERCISE DEVICE

TECHNICAL FIELD

The invention relates to exercise devices and in particular to devices using a member which provides resistance to the movement of the limbs of a user by the tension in the resistance member. More particularly, the invention relates to such a device having both a spring and flexible cord to provide various resistance characteristics as the members are stretched by a user.

BACKGROUND ART

Numerous exercise devices of the resistance type have been developed for strengthening various parts of the user's body in which the user stretches a spring or elastic cord whereby the resistance of the stretched member provides the exercise and muscle building feature of the device. These various devices consist of a combination of springs and elastic cords which are connected at their ends to various devices which are adapted to be manually held or secured to a user's body. Examples of such devices of the type in which a spring or elastic cord is used are shown in U.S. Pat. Nos. 2,760,774; 2,937,023; DES 203,836; 3,529,820; 3,807,730; 3,819,177; 3,838,852; 4,200,281; 4,251,071; 4,273,328; 4,340,218; 4,411,426; 4,423,866; and 4,489,937. Many of these prior devices are relatively bulky and expensive and are adaptable for use with only certain portions of the body. Also, as the spring or other elastic member is stretched, the resistance decreases at its outer limits. It is also a problem with certain of these devices that if the spring is stretched too far the spring could be damaged or break causing injury to the user.

Therefore, the need exists for an improved exercise device which provides the advantages of these prior art devices, yet overcomes the disadvantages thereof.

DISCLOSURE OF THE INVENTION

Objectives of the invention include providing an improved exercise device which is of an extremely simple, inexpensive and lightweight construction enabling it to be transported easily by the user in a suitcase for use during travel or stored in a convenient place for home use; and in which the resistance characteristics can be varied so that the resistance increases or is maintained relatively constant throughout the stretch length of the intervening spring and elastic cord.

Another objective is to provide such an improved device in which the resistance members are attached at both ends to a pair of elongated cuff strips which are formed into a pair of loops and secured on the wrist or ankles of the user by detachable Velcro type fasteners and in which the cuff strips are formed of a padded material to provide comfort to the user; and in which each strip has a reinforcing strip of material mounted thereon which forms a loop for securing the resistance spring and elastic cord to the cuff.

Still another objective of the invention is to provide such a device in which the elastic member consists of a coil extension spring and a length of elastic rubber cord which extends through the center of the coil spring; and in which the cord has a different resistance characteristic than that of the spring whereby it becomes effective at a predetermined amount of stretch of the spring to provide increased resistance as the spring is stretched without impeding the use of the device since the cord is contained within the spring.

A still further objective of the invention is to provide such an improved device in which the length of the flexible cord can be varied so as to become effective at different stretch lengths of the spring; and in which the cord preferably reaches its elastic limit before the spring reaches its limit to prevent overstressing the spring and to function as a safety cord should the spring break or separate from the cuffs. Furthermore, the spring can also function as a safety member for the cord in the event the elastic cord would break.

Still another objective of the invention is to provide such an improved exercise device in which the elastic cord preferably has less than one-half of the resistance force in comparison to the resistance force of the spring; and in which the spring is attached to the cuffs by a pair of metal rings secured to the cuffs by loops formed by one of the reinforcing strips, with the elastic cord being secured to the rings by square knots or the like.

These objectives and advantages are obtained by the improved exercise device of the invention the general nature of which may be stated as including, a pair of elongated cuff strips adapted to be formed into loops for receiving the limbs of a user; securing means mounted on each of the cuff strips for detachably securing said cuff strips into the loops; a ring attached to each of the cuff strips; a coil extension spring connected to and extending between the pair of rings; and an elastic cord attached to the rings and extending between the cuff strips and located within the coil spring.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
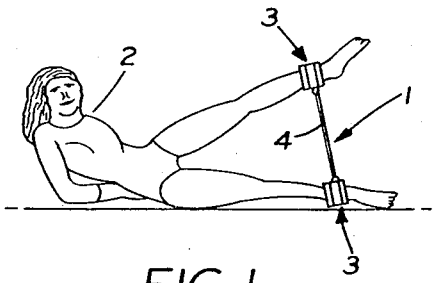
FIG. 1 is a diagrammatic perspective view showing one type of exercise which can be performed by a user of the improved exercise device of the invention.

The improved exercise device of the invention is indicated generally at 1 and is shown in FIG. 1 being used in one of a number of exercises by a person 2. Device 1 includes a pair of cuffs indicated generally at 3, an intervening coil spring 4 and an elastic cord 5. Each cuff 3 is similar to the other and, therefore, only one cuff is shown in detail in the drawings and described below.

Each cuff 3 includes an outer cover 7 (FIG. 3) preferably formed of nylon or other synthetic material, which is sewed about an internal resilient pad 8 formed of foam rubber or similar material. A reinforcing strip 9 is sewed to the outer cover 7 and extends throughout the longitudinal length thereof. An attachment strap indicated generally at 11, is mounted on reinforcing strip 9 and consists of a pile and hook material such as Velcro. Strap 11 consists of a strip 12 of loop material which extends outwardly from one end of reinforcing strip 9 and a pile strip 13 secured to and extending outwardly from the opposite end of reinforcing strip 9 (FIG. 3).

A loop-forming strip of reinforcing material 15, preferably high strength nylon or similar synthetic material, is attached to reinforcing strip 9 and extends therealong. An unsecured portion of strip 15 forms a loop 17 in which a metal ring 19 is located. Strip 15 preferably is firmly secured to reinforcing strip 9 by cross-stitching 20 on both sides of loop 17 to form a secure loop for the mounting of metal ring 19 therein.

Figure 3:
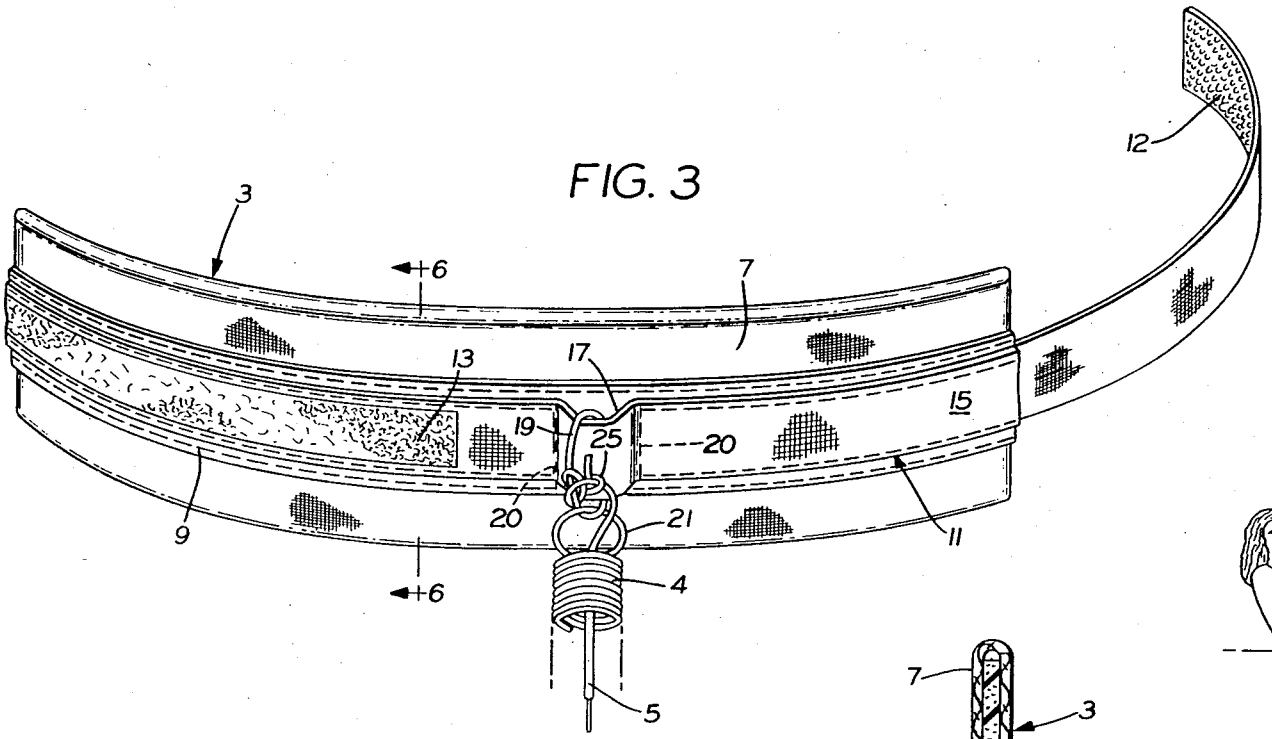
FIG. 3 is a perspective view of one of the cuff strips in an open position showing its connection with the spring and elastic cord.
Figure 6:
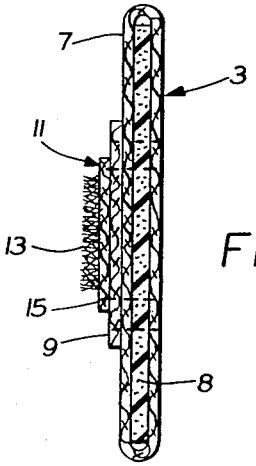
FIG. 6 is an enlarged sectional view taken on line 6—6, FIG. 3.
Figure 5:
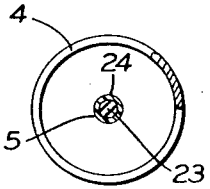
FIG. 5 is an enlarged sectional view taken on line 5—5, FIG. 4.
Figure 2:
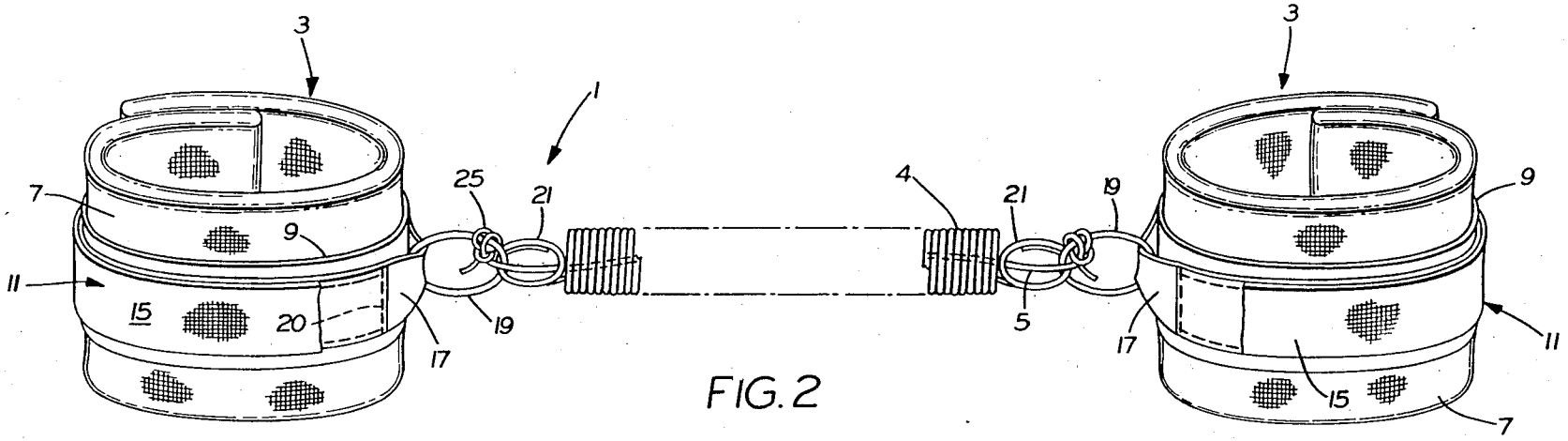
FIG. 2 is an enlarged perspective view of the device with the cuff strips being in the closed loop position.
Figure 4:
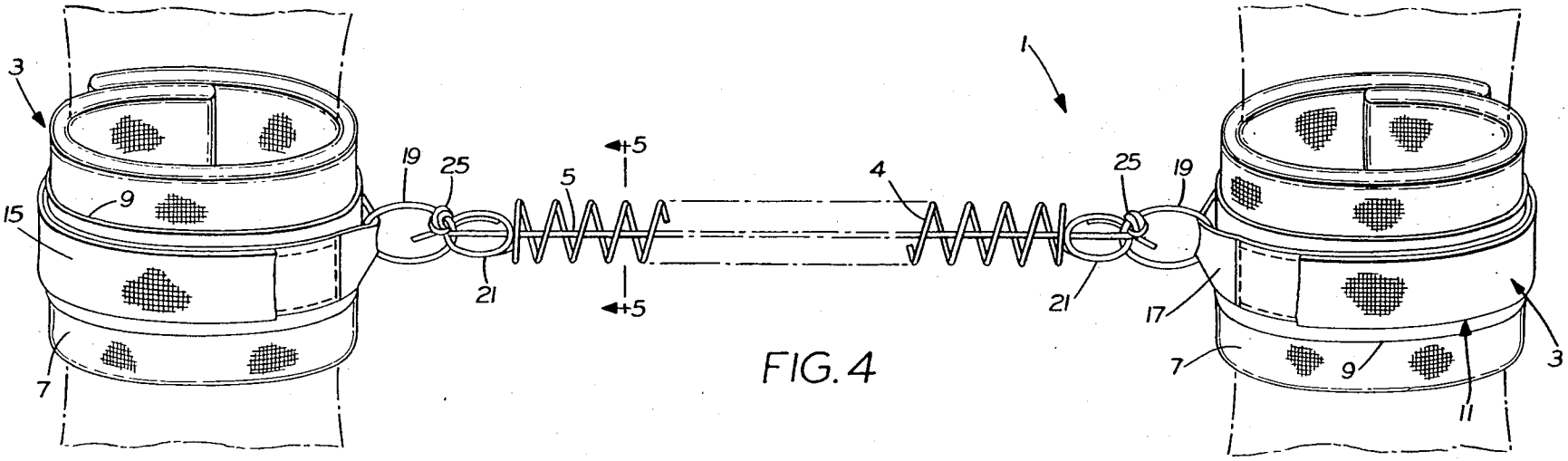
FIG. 4 is a view similar to FIG. 2, with the spring and cord being shown in the stretched position.

Spring 4 is a tension coil spring terminating at end loops 21 for loosely securing it in metal rings 19 (FIGS. 2 and 3 on both cuffs. An elastic cord 5 preferably having a solid rubber core 23 and an outer coating of polyester 24 or other suitable material (FIG. 5), is secured preferably by a square-knot 25 or other type of attachment, at both of its ends to metal rings 19 as shown in the drawings. Elastic cord 5 preferably is not stretched tightly between cuffs 3 when spring 4 is in an unstretched condition (FIG. 2), but has some slack therein so that it does not begin to stretch until after spring 4 has stretched a predetermined amount as shown in FIG. 4.

The operation of the improved exercise device 1 is shown primarily in FIGS. 1, 2 and 3. Cuffs 3 are placed around the wrists and/or ankles of a user and secured thereon by engagement of strips 12 and 13 of attachment strap 11. The user by movement of the limbs away from each other will cause spring 4 to stretch providing resistance to the outward movement of the limbs. Upon the spring stretching to a predetermined length elastic cord 5 also will begin to stretch increasing the resistance to the continued outward movement of the limbs. In normal spring exercise devices the spring resistance decreases since the spring has been stretched to its outer limits.

Due to the location of the cord within the spring it does not affect the operation of the device and does not provide a cumbersome device as in prior exercise devices, yet enables a variety of resistance characteristics to be achieved. Should the user desire a different resistance characteristic at different lengths of separation of cuffs 3 and correspondingly of the associated limbs, the length of the cord can be changed easily by attaching one end thereof at a different length on ring 19. This enables the resistance force of the elastic cord to occur at different amounts of separation of a user's limbs to provide a variety of resistance characteristics for the individual user.

Preferably the elastic limit of the cord will be reached before the elastic limit of the spring although the same need not occur in this manner. Also, both the spring and cord provide a safety feature for the other whereby should either the spring or the cord break, the other remaining component will serve as a safety feature to prevent injury to the user of device 1.

In a preferred embodiment spring 4 will have a length between 6½" and 7½" which provides the desired separation between cuffs 3 at the start of an exercise. Spring 4 preferably will have a force factor at least twice that of cord 5. However, these relationships and sizes can change without affecting the concept of the invention.

The particular construction of cuffs 3 provides a device which is comfortable to the user, yet provides a secure attachment to the user's limbs by the relatively long length of Velcro material for securing the cuff in a wrapped position about the user's ankle and/or wrist.

Accordingly, improved device 1 is a relatively inexpensive yet efficient device for performing various exercises by the user in complete safety and without injuring the wrists or ankles to which the device is attached due to the comfort of the cuffs. Most importantly device 1 provides a variety of resistance characteristics by simple adjustment of the length of internal elastic cord 5.

Accordingly, the improved exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved exercise device is constructed and used, the characteristics of the construction, and the advantageous, new and useful results obtained; the new and useful structures, devices, elements, arrangements, parts, and combinations, are set forth in the appended claims.

What is claimed is:

1. An improved exercise device including:

(a) a pair of elongated cuff strips adapted to be formed into loops for receiving limbs of a user, said cuff strips each having a resilient pad of material contained within an outer cover;

(b) a releasable mating pair of a hook and pile fabric strip mounted on each of the cuff strips for detachably securing said cuff strips into the loops;

(c) first and second reinforcing strips of material, said first reinforcing strip being attached to the outer cover and extending generally throughout the length of the cuff strip, said second reinforcing strip being attached to and extending along a portion of the first reinforcing strip and having a loop formed therein;

(d) a pair of rings, said rings each being secured within the loop formed in the second reinforcing strip of a respective one of the cuff strips;

(e) a coil tension spring connected to and extending between the pair of rings; and (f) an elastic cord adjustably attached to and extending between the pair of cuff strips and located within the coil spring, wherein the ends of said elastic cord are attached to the cuff strips at said spring attachment rings.

2. The exercise device defined in claim 1 in which the elastic cord has a resistance factor less than one-half of the spring resistance factor.

3. The exercise device defined in claim 1 in which the elastic cord reaches its elastic limit before the spring to limit the separation movement of the cuff strips.

4. The exercise device defined in claim 1 in which the elastic cord is a polyester covered rubber.

5. The exercise device defined in claim 1 in which the length of the spring is within the range of 6½" and 7½".

* * * * *